United States Patent [19]

Doctor

[11] Patent Number: 4,667,479

[45] Date of Patent: May 26, 1987

[54] AIR AND WATER CONDITIONER FOR INDOOR SWIMMING POOL

[76] Inventor: Titu R. Doctor, 7530 Lovely La., Orlando, Fla. 32810

[21] Appl. No.: 808,282

[22] Filed: Dec. 12, 1985

[51] Int. Cl.[4] ..... F25B 13/00

[52] U.S. Cl. ..... 62/93; 62/238.7; 62/324.5

[58] Field of Search ..... 62/238.7, 324.3, 324.5, 62/324.1, 238.6, 260, 93

[56] References Cited

U.S. PATENT DOCUMENTS

| | | | |
|---|---|---|---|
| 3,399,540 | 9/1968 | Kahmann | 62/260 X |
| 3,851,822 | 12/1974 | Pocrnja et al. | 62/93 X |
| 4,019,338 | 4/1977 | Poteet | 62/324.3 X |
| 4,232,529 | 11/1980 | Babbitt et al. | 62/238.6 X |
| 4,238,933 | 12/1980 | Coombs | 62/238.7 |
| 4,279,128 | 7/1981 | Leniger | 62/238.6 |
| 4,517,810 | 5/1985 | Foley et al. | 62/238.6 X |
| 4,557,116 | 12/1985 | Kittler | 62/238.6 |

*Primary Examiner*—William E. Tapolcai
*Attorney, Agent, or Firm*—Krass & Young

[57] ABSTRACT

A method and apparatus for heating, cooling and dehumidifying the enclosure air from an indoor swimming pool while simultaneously heating or cooling the pool water. The system includes a water to air heat pump and an air to air heat pump with the water coil of the water to air heat pump arranged in heat exchange relation to the pool water and the air coil from the water to air heat pump, together with the two air coils from the air to air heat pump, arranged such that the enclosure air first passes over one air coil of the air to air heat pump, thereafter passes over the air coil of the water to air heat pump, and thereafter passes over the second air coil of the air to air heat pump prior to being reintroduced into the enclosure. Each heat pump includes a reversing valve so that the various coils may function as either an evaporator or a condenser with the result that heating or cooling of the pool water and heating, cooling and dehumidifying of the enclosure air may be selectively performed in accordance with the specific instantaneous demands of the pool water and the enclosure air.

2 Claims, 1 Drawing Figure

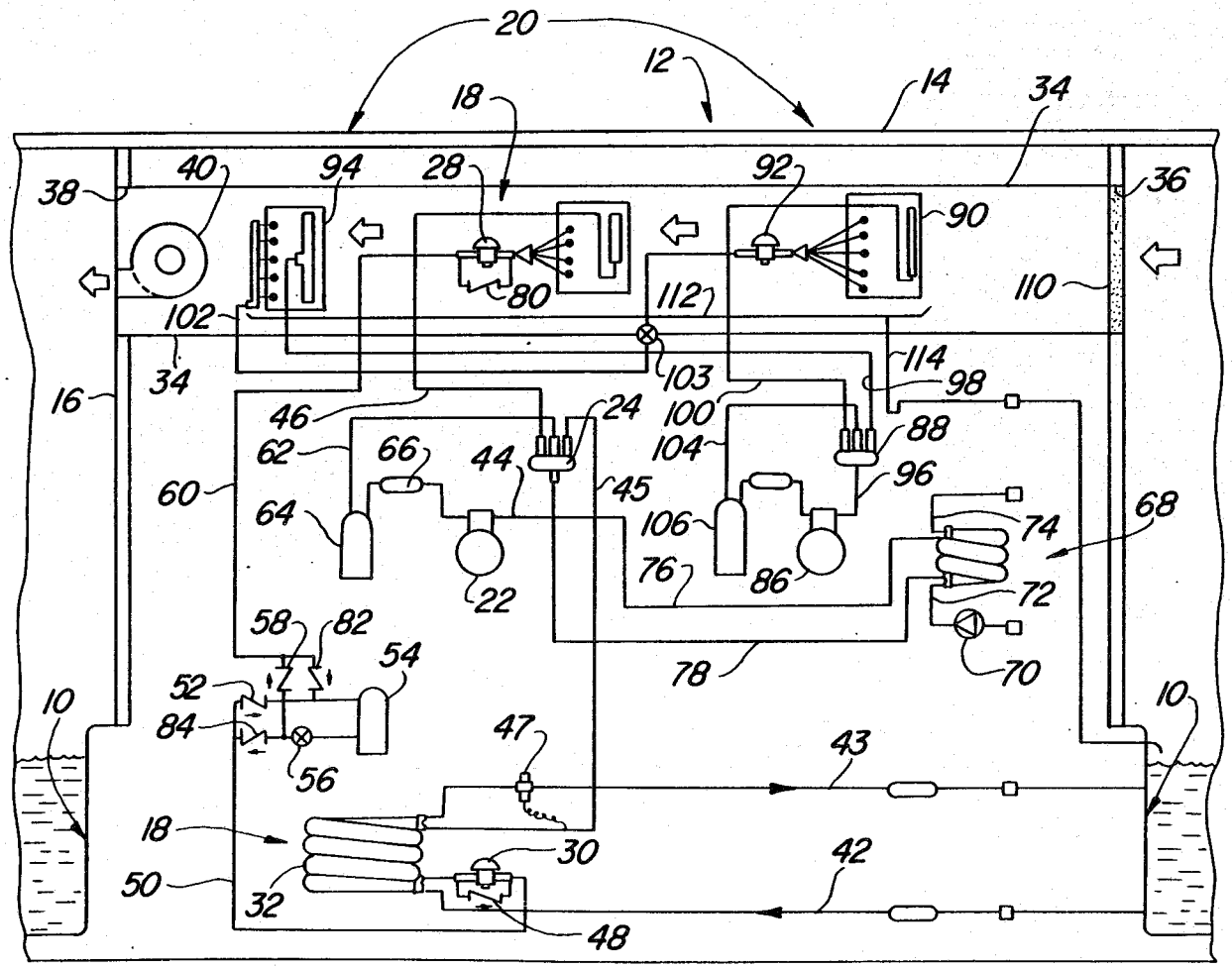
10
36
68
110
34
74
72
70
14
90
98
114
88
96
43
42
92
86
12
112
103
100
104
106
76
78
24
45
48
30
20
18
80
28
44
22
47
66
54
94
82
56
46
62
64
58
32
40
102
34
60
52
84
18
50
38
16
10

AIR AND WATER CONDITIONER FOR INDOOR SWIMMING POOL

BACKGROUND OF THE INVENTION

This invention relates to method and apparatus for conditioning air and water and, more particularly, to a method and apparatus specifically designed to condition the air and water of an indoor swimming pool system.

Indoor swimming pool systems require several conditioning operations. Specifically, the enclosure air must be heated or cooled; the enclosure air must be dehumidified; and the pool water must be heated or cooled. Many systems have been proposed for providing these several conditioning requirements for an indoor swimming pool system.

In one such prior art system, air is condinuously exhausted from the enclosure to eliminate the humid enclosure air, fresh makeup air is provided on a continuing basis, and a separate electric or fossil fuel heater is provided to heat the pool water. This is a very energy inefficient system since a large amount of the energy required to heat the fresh incoming air is rejected to the atmosphere.

In an attempt to improve the energy efficiency of indoor pool conditioning systems, it has been proposed to provide an air to air heat pump employing two air coils with one air coil functioning to cool and dehumidify the enclosure air and the second coil functioning to reheat the air prior to its reintroduction into the enclosure. Such an apparatus, however, cannot provide the entire heat required to make up for the heat losses of the enclosure and consequently must be used as an adjunct to an existing heating system.

Different combinations of water to air heat pumps have also been proposed in which the circulation of the refrigerant is divided between two or more condensers. These systems, besides dehumidifying the air, provide a partial heating of the pool water and a partial reheating of the enclosure air but do not cover the heat losses of the enclosure and, as in the case of the air to air heat pump systems, require an additional system to heat the enclosure air.

It is also been proposed to provide two water to air heat pumps. The enclosure air is cooled and heated through the two air coils and the pool water is circulated in parallel through the two water coils where it is cooled or heated and mixed to provide a slight increase in water temperature. This system is relatively energy efficient but is limited in its dehumidifying capacity.

SUMMARY OF THE INVENTION

The present invention is directed to the provision of a method and apparatus for conditioning the air and water of an indoor swimming pool system in an effective and energy efficient manner.

In broad principle, the invention consists of the provision of an air to air heat pump and a water to air heat pump wherein the water coil of the water to air heat pump is placed in heat exchange relation to the water of the pool and the air coil of the water to air heat pump, together with the two air coils of the air to air heat pump, are placed in heat exchange relation to the air of the pool enclosure. This arrangement provides an efficient and effective method and apparatus for heating or cooling the pool water, heating or cooling the enclosure air, and dehumidifying the enclosure air.

According to an important feature of the invention, the air coil of the water to air heat pump and both air coils of the air to air heat pump are arranged in serial fashion and the air from the enclosure is moved serially over the air coils and back to the enclosure. This arrangement allows the several, serially arranged air coils to be selectively employed to provide dehumidification, heating, or cooling of the enclosure air.

According to a further feature of the invention, the enclosure air is moved over one air coil of the air to air heat pump, then over the air coil of the water to air heat pump and then over the other air coil of the air to air heat pump. This arrangement provides a compact and extremely energy efficient method and apparatus for providing all of the required water and air conditioning functions.

According to a further feature of the invention, each heat pump includes a reversing valve so that each of the coils may function as either a condenser or an evaporator and the direction of refrigerant flow is selectively reversed to the coil so that each coil may perform either as a condenser to heat the associated heat exchange fluid or as an evaporator to cool the associated heat exchange fluid. This arrangement provides maximum flexibility with respect to the ability of the various coils to selectively and cooperatively perform all of the required conditioning functions with respect to both the pool water and the enclosure air.

BRIEF DESCRIPTION OF THE DRAWING

The single FIGURE of the drawing is a schematic representation of the air and water conditioner of the invention shown in association with an indoor swimming pool system.

DETAILED DESCRIPTION OF THE PREFERRED EMBODIMENT

The invention conditioning system is shown in association with an indoor swimming pool system including a pool 10 and an enclosure 12 having a roof 14 and an enclosure wall 16. Although the pool and enclosure appear as separated left and right sections in the drawing, it will be understood that this arrangement is a developed view for purposes of illustration and that, in actuality, the invention contemplates a single continuous pool 10, a single continuous enclosure 12, and a single continuous enclosure wall 16.

The invention conditioner, broadly considered, includes a water to air heat pump 18 and an air to air heat pump 20.

Water to air heat pump 18 includes a compressor 22, a reversing valve 24, an air coil 26, a first expansion valve 28, a second expansion valve 30, and a water coil 32.

Air coil 26 is positioned in a conduit 34 extending between an inlet 36 in pool wall 16 and an outlet 38 in pool wall 16, and water coil 32 is placed in heat exchange relation to the pool water. Enclosure air is moved over air coil 26 by a blower 40 positioned in the outlet of conduit 34 and pool water is passed over water coil 32 by pool inlet and pool outlet pipes 42 and 43 communicating with pool 10 and wrapping in heat exchange relation around water coil 32.

The refrigerant of water to air heat pump 18 is pumped by compressor 22 through a high pressure line 44 to reversing valve 24. Reversing valve 24 functions to direct the hot gas from compressor 22 either to water coil 32 through a pipe 45 or to air coil 26 through a pipe 46. When reversing valve 24 is actuated in a sense to pass the refrigerant from compressor 22 directly to water coil 32, water coil 32 acts as a condenser so that the pool water circulating through pipes 42 and 43 in heat exchange relation to coil 32 is heated. A modulating valve 47 in outlet line 44 is actuated by the refrigerant pressure in pipe 45 to modulate the water flow over water coil 32. A separate pump may be provided to circulate water through lines 42 and 43 or the existing pool water circulating pump may be employed to provide this circulation.

The liquid refrigerant leaving water coil 32 flows through a check valve 46 bypassing expansion valve 30 and thence through high pressure liquid line 50 through a check valve 52. From check valve 52 the high pressure liquid flows into a receiver tank 54 and from receiver tank 54 flows through a moisture indicator 56. From moisture indicator 56 the liquid refrigerant flows through a check valve 58 and thence through a high pressure liquid line 60 to expansion valve 28. The refrigerant, after losing pressure in expansion valve 28, evaporates in air coil 26 so that air coil 26 acts as an evaporator to cool the enclosure air passing through conduit 34. Air coil 26 may be a conventional air to refrigerant heat exchanger with tubes and fins. The humid air flowing over air coil 26 is cooled and the moisture is condensed on the cold surfaces of the air coil. From air coil 26 the refrigerant is returned to the compressor 22 as vapor through line 46, reversing valve 24, suction line 62, accumulator 64, and a filter dryer 66.

As an option, a domestic hot water provider 68 can be installed on the high pressure line 46. Circulation of the domestic hot water is activated by a circulating pump 70 which moves the hot water through pipes 72 and 74 in heat exchange relation to refrigerant delivered to and from hot water provider 68 through refrigerant lines 76 and 78.

When the hot gas refrigerant is directed from the compressor 22 through reversing valve 24 directly to air coil 26, air coil 26 becomes a condenser and functions to transfer the heat from the refrigerant to the air passing through conduit 34. The collected liquid refrigerant from air coil 26 passes through a check valve 80 bypassing expansion valve 28 and thence through liquid line 60 and a check valve 82 through receiver 54. From the receiver 54, the liquid refrigerant flows through the moisture indicator 56 and a check valve 84 to expansion valve 30 where it expands. In this mode, water coil 32 functions as an evaporator and the liquid refrigerant vaporizes inside the coil. The pool water circulating in heat exchange relation to water coil 32 thus gives up heat to the refrigerant and is cooled. The vaporized refrigerant returns to compressor 22 through gas line 26, reversing valve 24, suction line 62, accumulator 64, and filter dryer 66.

Air to air heat pump 20 includes a compressor 86, a reversing valve 88, an air coil 90, an expansion valve 92; and a further air coil 94. Air coils 90 and 94 are conventional air to refrigerant heat exchangers with tubes and fins.

The refrigerant in air to air heat pump 20 is pumped by a compressor 86 through a high pressure gas line 96 to reversing valve 88 where it is directed as a hot gas either to air coil 94 through a pipe 98 or to air coil 90 through a pipe 100.

When the refrigerant is directed from reversing valve 88 to air coil 94, this coil becomes a condenser and the heat from the refrigerant is dissipated in the air coil and given up to the air passing over the air coil through conduit 34. Liquid refrigerant formed in air coil 94 flows through high pressure liquid line 102 and through a moisture indicator 103 to expansion valve 92. After the pressure drop in expansion valve 92, the refrigerant evaporates in air coil 90 so that air coil 90 functions as an evaporator to absorb heat from enclosure air passing through conduit 34 to cool the air and condense moisture from the air. From air coil 90 the refrigerant is returned to compressor 86 as a vapor through line 100, reversing valve 88, a suction line 104, an accumulator 106, and a filter dryer 108.

When the hot gas refrigerant is directed from compressor 86 through reversing valve 88 directly to air coil 90, this coil becomes a condenser and the air coil 94 becomes an evaporator. Expansion valve 92 is of a bidirectional type so as to function in both modes.

The enclosure air enters conduit 34 through a filter 110 positioned in enclosure wall 16. Enclosure air moves respectively and serially over air coil 90, air coil 26, and air coil 94. Blower 40 moves the air through conduit 34 and provides sufficient pressure differential for an adequate distribution duct work.

The moisture extracted from the enclosure air moving through conduit 34 is collected as condensation in a drain pan 112 and is evacuated through a pipe 114 for return to the pool 10.

According to the invention, a combination of different functions may be provided with both heat pumps running at the same time or with only one heat pump running, and the various functions may be selectively combined and coacted to provide varying steps of dehumidification, cooling and heating of the enclosure air as well as heating or cooling of the pool water.

For example, the air coil 26 of water to air heat pump 18 may be operated in an evaporator mode, the water coil 32 of heat pump 18 may be operated in a condenser mode, air coil 90 of air to air heat pump 20 may be operated in an evaporator mode, and air coil 94 of heat pump 18 may be operated in a condenser mode. With this arrangement, the enclosure air passing through conduit 34 is cooled and dehumidified by air coil 90, further cooled and dehumidified by air coil 26, and then reheated by air coil 94 prior to being reintroduced into the pool enclosure. At the same time, water coil 32 functions to heat the pool water.

As a further example, water to air heat pump 18 may be operated alone, without operation of air to air heat pump 20, in which event air coil 26 may function to cool the enclosure air passing through conduit 34 and water coil 32 may function to heat the pool water or, alternatively, air coil 26 may function to heat the enclosure air and water coil 32 may function to cool the pool water.

As a further example, air to air heat exchanger 20 may be operated alone, without operation of water to air heat exchanger 18, in which event air coil 90 may cool and dehumidify the enclosure air passing through conduit 34 whereafter air coil 94 may function to reheat the enclosure prior to its reintroduction into the enclosure.

As a further example, both heat pumps may be operated with air coil 90 functioning as an evaporator, air coil 94 functioning as a condenser, air coil 26 functioning as a condenser, and water coil 32 functioning as an evaporator. With this arrangement, water coil 32 functions to cool the pool water, and the enclosure air passing through conduit 34 is cooled and dehumidified by air coil 90 whereafter it is heated by air coil 26 and then further heated by air coil 94 prior to its reintroduction into the enclosure.

The invention conditioning system will be seen to provide an efficient and effective method and apparatus for dehumidifying, heating or cooling the enclosure air from an indoor swimming pool while simultaneously heating or cooling the pool water. Specifically, the invention conditioning system provides effective heating for the enclosure air and for the water and further provides a dehumidifying capacity that is competitive to dedicated dehumidifying equipment. The heat pumps may be controlled manually or, preferably, may be controlled by suitable thermostatic and humidistatic devices associated with the enclosure air and with the pool water.

Specifically, the control circuitry for the system would be arranged such that if the thermostat called for heating, a heating mode would automatically be selected and when the heating demand was satisfied and the humidistat called for dehumidification, a dehumidifying mode would be automatically selected. If both conditions were satisfied, the machine would automatically be shut off. Conversely, if the thermostat called for cooling, a cooling mode would be automatically selected. It will also be apparent that the rate at which refrigerant is moved through the heat pumps may be selectively regulated to accommodate various pool water or enclosure air requirements.

Whereas a preferred embodiment of the invention has been illustrated and described in detail, it will be apparent that various changes may be made in the disclosed embodiment without departing from the scope or spirit of the invention.

I claim:

1. A method for conditioning the air and water in an enclosed swimming pool system comprising the steps of:

(A) providing a closed loop air to air heat pump system including two air coils, a compressor, an expansion valve, and a quantity of refrigerant flowing through the closed loop;

(B) providing a closed loop water to air heat pump system including a water coil, an air coil, a compressor, an expansion valve, and a quantity of refrigerant flowing through the closed loop;

(C) passing water from said pool in heat exchange relation to said water coil of said water to air heat pump system;

(D) passing air from said enclosure in heat exchange relation to said air coil of said water to air heat pump system and both of said air coils of said air to air heat pump system;

(E) providing a reversing valve so that each of said coils may function as either a condenser or an evaporator; and (F) selectively reversing the direction of refrigerant flow through the closed loop of each heat pump system so that each coil may perform either as a condenser to heat the associated heat exchange fluid or as an evaporator to cool the associated heat exchange fluid.

2. An apparatus for conditioning the air and water in an enclosed swimming pool system comprising:

(A) a closed loop water to air heat pump system including a water coil arranged in heat exchange relation to the water of the pool, an air coil arranged in heat exchange relation to the air of the enclosure, a compressor, an expansion valve and a quantity of refrigerant flowing through the closed loop;

(B) a closed loop air to air heat pump system including two air coils arranged in heat exchange relation to the air in the enclosure, a compressor, an expansion valve, and a quantity of refrigerant flowing through the closed loop;

(C) air moving means operative to move the air from the enclosure over one air coil of said air to air heat pump system, then over said air coil of said water to air heat pump system, then over the other air coil of said air to air heat pump system, and then back to the enclosure; and (D) a reversing valve in each heat pump system so that the direction of refrigerant flow through the closed loops may be selectively reversed to enable each of said coils to function either as a condenser or as an evaporator.

* * * * *